US009456952B2

(12) United States Patent
Cook

(10) Patent No.: US 9,456,952 B2
(45) Date of Patent: Oct. 4, 2016

(54) THERAPEUTIC MOBILITY ASSISTIVE DEVICE

(71) Applicant: Ian K Cook, Christiansted, VI (US)

(72) Inventor: Ian K Cook, Christiansted, VI (US)

( * ) Notice: Subject to any disclaimer, the term of this patent is extended or adjusted under 35 U.S.C. 154(b) by 106 days.

(21) Appl. No.: 13/999,353

(22) Filed: Feb. 13, 2014

(65) Prior Publication Data

US 2015/0224014 A1 Aug. 13, 2015

(51) Int. Cl.
*A61H 3/04* (2006.01)
*A61H 3/00* (2006.01)

(52) U.S. Cl.
CPC ..... *A61H 3/04* (2013.01); *A61H 3/008* (2013.01); *A61H 2003/007* (2013.01); *A61H 2201/0161* (2013.01); *A61H 2201/0165* (2013.01)

(58) Field of Classification Search
CPC .. A61H 3/04; A61H 3/008; A61H 2003/007; A61H 2201/0161; A61H 2201/0165
USPC ..... 280/87.041, 87.051, 657
See application file for complete search history.

(56) References Cited

U.S. PATENT DOCUMENTS

| | | | | | |
|---|---|---|---|---|---|
| 170,544 | A * | 11/1875 | Garcia | 297/6 |
| 196,730 | A * | 10/1877 | Wick | 297/5 |
| 282,980 | A * | 8/1883 | Habegger | 482/68 |
| 320,462 | A * | 6/1885 | Cowing | 482/68 |
| 2,538,324 | A * | 1/1951 | Petrie | 280/87.051 |
| 4,272,071 | A * | 6/1981 | Bolton | 482/67 |
| 4,342,465 | A * | 8/1982 | Stillings | 280/87.051 |
| 4,770,410 | A * | 9/1988 | Brown | 482/68 |
| 4,773,639 | A * | 9/1988 | Graves | 482/66 |
| 4,953,851 | A * | 9/1990 | Sherlock et al. | 482/66 |
| 5,040,556 | A * | 8/1991 | Raines | 135/67 |
| 5,228,708 | A * | 7/1993 | Verdugo | 280/200 |
| 5,351,700 | A * | 10/1994 | Jones et al. | 135/67 |
| 5,380,262 | A * | 1/1995 | Austin | 482/68 |
| 5,476,432 | A * | 12/1995 | Dickens | 482/67 |
| 5,921,567 | A * | 7/1999 | Brown | 280/87.051 |
| 6,170,840 | B1 * | 1/2001 | Mathias | A63B 69/0064 135/69 |
| 6,527,285 | B1 * | 3/2003 | Calandro, II | 280/87.051 |
| 6,704,949 | B2 * | 3/2004 | Waldman et al. | 5/93.1 |
| 6,948,727 | B1 * | 9/2005 | Bakken | 280/87.021 |
| 7,070,188 | B2 * | 7/2006 | Waldman et al. | 280/31 |
| 9,089,194 | B2 * | 7/2015 | Tessier | A45B 1/00 |
| 2010/0170546 | A1 * | 7/2010 | Popovic et al. | 135/67 |

FOREIGN PATENT DOCUMENTS

| | | | | |
|---|---|---|---|---|
| FR | 2983707 A1 * | 6/2013 | | A61H 3/04 |
| WO | WO 2013075163 A1 * | 5/2013 | | A61H 3/04 |

* cited by examiner

*Primary Examiner* — John Walters
*Assistant Examiner* — Brian Swenson
(74) *Attorney, Agent, or Firm* — Elizabeth Stanley

(57) ABSTRACT

A therapeutic mobility assistive device provides safe, stable ambulatory activity while reducing lower extremity swelling and improving muscle strength, balance, muscle coordination, nerve function and circulation, walking ability, walking endurance and gait training, all at the user's pace. The device is simple to use and flexible in design to accommodate varying body sizes. Whether in closed or first and second open positions via telescoping portions, the device prevents risk of fall and instability issues during periods of rest and ambulatory activity.

19 Claims, 4 Drawing Sheets

THERAPEUTIC MOBILITY ASSISTIVE DEVICE

FIELD OF THE INVENTION

The present invention relates generally to a therapeutic aid for ambulatory activity. More specifically, the present invention is directed to a therapeutic walking assistive device that improves balance, mobility, strength, endurance, gait training and walking ability of the user.

BACKGROUND OF THE INVENTION

As advances in medicine allow people to live much longer lives, sustaining one's walking ability becomes increasingly important for overall well-being and prolonged independent living. Various segments of the population that have experienced challenges with walking include individuals affected by one or more long-term serious health conditions such as cerebral vascular accidents, certain heart diseases, and diseases that cause muscle atrophy.

While these types of health issues are not limited to the elderly anymore, even older adults, including baby boomers, are the one segment of the aging population who experience persistent difficulties with walking and re-learning to walk after crippling illnesses.

Another equally important segment of the population that experience persistent difficulties with walking, especially re-training the brain to walk after neurological conditions, is individuals with traumatic brain injuries (TBI). TBI patients are well documented in contact professional sports, such as football, as well as in various branches of the military.

Generally, nurses, rehabilitation department personnel and physical medicine doctors encourage patients to improve their walking ability in order to avoid secondary illnesses that may develop, or to prevent primary conditions from becoming worse.

A major concern, however, for health practitioners as well as homecare providers in dealing with such patients is safety—their risk of falling. In conventional assistive devices, the structures are oftentimes complicated, cumbersome, costly, too restrictive and non-therapeutic to the patient. From my professional experience, patients succumb to the lack of balance, muscle weakness and/or pain, become discouraged and then lose hope in their ability to walk. Ultimately, they lose all mobility and the quality of life that comes with independence.

SUMMARY OF THE INVENTION

All of these and other related problems of immobility are solved by the therapeutic walking assistive device of the present invention. The present invention not only provides safe walking ability, but also improves balance, muscle coordination, muscle strength, nerve function and circulation, as well as reduces lower extremity swelling. These are exemplary health benefits a user experiences through use of the present invention.

Unlike conventional assistive walking devices, the present invention is simple to use, durable, and flexible in design, which facilitates improved muscle strength, mobility and walking endurance while restoring user balance and coordination, all at the user's pace. The present invention is customizable, easy to enter and exit safely, designed to accommodate varying body measurements (i.e. sizes, height, weight, etc.), and designed to prevent user imbalance or instability.

In other words, the present invention is multi-functional and therapeutic in applications where mobility is an impairment resulting from, but not limited to, one or more of the following: muscle weakness, pain, spasticity, poor balance, low levels of physical activity, reduced tolerance to activity and/or a sedentary lifestyle, for example.

In addition, in instances where a lack of resources for long-term rehabilitation services may occur, the present invention is a compelling solution to strengthen and restore user balance and confidence of not falling, to improve safe balanced mobility, improve walking ability and walking endurance, and improve gait training at the user's own pace substantially unassisted.

In a preferred embodiment, the present invention comprises three support rings of three varying circumferences or diameters, and five anchor columns, all made of a high-strength material with a desired finish that reduces corrosion, whereby the rings and columns are of a unitary integral construction. Each anchor column has a wheel assembly at a base end for moving the device as desired. The invention also includes a harness or seat portion with five fastener connections, which preferably mates to five corresponding fastener connections in the vicinity of the top ends on the five anchor columns, at approximately near the top support ring.

For ease of discussion, each support ring has a front and back, and is configured in a stacking arrangement with the ring forming the smallest circumference or diameter at the top, and the ring forming the largest circumference or diameter at the bottom. Each support ring is not necessarily limited to a circular shape. Preferably, the ring forming the smallest circumference is configured in the vicinity of the user's waist, preferably below the user's elbow, and the ring forming the largest circumference is configured in the vicinity of the user's ankle.

Since the present invention is customizable for each individual—such as in sizes of small, medium, large, extra large, etc.—the vertical distance between each of the three support rings varies to accommodate the user's gait cycle. For example, the vertical distance between each support ring is preferably between eight and sixteen inches, and the vertical distance between the smallest and largest support ring is preferably between sixteen and thirty-two inches, depending on the dimensions of the user.

In addition, to ensure stability of the present invention, each of the three support rings is supported vertically by five anchor columns in angularly positioned connections around the support rings. For example, one anchor column is located in the back of the device and is preferably integral with or connected vertically to the circumference of each support ring. Approximately ninety degrees to the left hand side and right hand side of the back anchor column, are vertically positioned two more anchor columns that substantially stabilize the sides of the present invention. To adequately stabilize the front of the device, another two more anchor columns are each vertically positioned around the support rings approximately 150 degrees to the left hand side and right hand side from the back anchor column.

At the front of each support ring, at approximately 180 degrees from the back anchor column, is a fastening mechanism, which is attached to a column portion that connects all three support rings unitarily. When the fastening mechanism on each support ring is in an unlocked position, all of the telescoping portions of the three support rings are free to slide telescopingly in a direction towards the rear of the device, thereby creating an opening in a first position and a second position for the user to enter the present invention.

In other words, when the ring portions of each support ring telescope in a direction from front to back, the column portion, connecting all three support rings, on the right hand side of the back anchor column that is positioned at approximately 180 degrees from the rear anchor column, moves rearwardly to a position ranging between 151-155 degrees from the back anchor column on the right hand side, adjacent and substantially juxtaposed to the anchor column that is approximately 150 degrees from the back anchor column also on the right hand side. This movement is duplicated for the column portion on the left hand side of the rear anchor column.

When this happens, a first open position of the device is created where the back anchor column remains in substantially the same position, the two anchor columns positioned at approximately 90 degrees each on the right and left hand sides from the back anchor column also remains in substantially the same position, and the other two anchor columns positioned at approximately 150 degrees each on the right and left hand sides from the back anchor column also remains in substantially the same position.

Notwithstanding the above opening, which is the first open position of the device, when the ring portions of each support ring further telescope in a direction from front to back, the anchor column on the right hand side of the back anchor column that is positioned at approximately 150 degrees from the back anchor column, moves further rearwardly to a position that is approximately 91-100 degrees from the back anchor column on the right hand side, adjacent and substantially juxtaposed to the anchor column that is approximately 90 degrees from the back anchor column also on the right hand side. This further movement is duplicated on the left hand side for the anchor column that is positioned at approximately 150 degrees from the back anchor column.

When this happens, a second open position of the device is created where the back anchor column remains in substantially the same position, the two anchor columns positioned at approximately 90 degrees each on the right and left hand sides from the back anchor column also remains in substantially the same position, but the other two anchor columns positioned at approximately 150 degrees each on the right and left hand sides from the back anchor column, further moves into a position that is approximately 91-100 degrees each on the right and left hand sides from the back anchor column, adjacent to the anchor columns positioned at approximately 90 degrees each on the right and left hand sides from the back anchor column.

So in a second open position of the device, with respect to the back anchor column, the two side anchor columns are each positioned substantially equidistantly 90 degrees apart, from the left and right hand sides of the back anchor column. Similarly, with respect to the back anchor column, the other two anchor columns were telescoped further into side positions that are each positioned substantially equidistantly 91-100 degrees from the left and right hand sides of the back anchor column. Whether the device is in a first open position or a second open position, for ingress or egress, or in a closed position, the device of the present invention is thus stabilized.

The therapeutic assistive device of the present invention is also equipped with a harness assembly to adequately secure a user for safe operation. The harness assembly includes a seat or seat portion and security straps. The seat portion is of a general circular configuration to accommodate a user's posterior and leg(s). Like the security straps, the seat is preferably flexible and constructed of a durable, high-strength, light-weight material that accommodates desired strength loads and stresses.

There are preferably five security straps, each having a male part, which is the first strap part, and a female part, which is the second strap part that receives the male part. The male part is at the distal end of the first strap part, and the female part is at the distal end of the second strap part. Three of the five security straps are fixedly connected at top ends of the rear and two front anchor columns. As such, the two front security straps are preferably located at approximately 150 degrees from the rear security strap. The other two security straps are preferably fixedly attached to the smallest support ring, which is preferably at the top of the support ring stacking arrangement, at approximately 45 degrees from either side of the rear anchor column, and consequently at approximately 45 degrees from either side of the rear security strap.

Preferably, the security straps are customizable by configuration, color, shape and the like, to prevent unwanted or inaccurate connections. For example, each security strap in its entirety—the strap, the male part and the corresponding female part—is preferably in the same color such that five different colors exist for the five security straps. Alternatively, only the pair of male and female parts may be color coded differently.

In yet another example, the male part and the corresponding female part of each strap may be shaped in a distinguishable configuration such that five different pairs of male/female part configurations exist for the five security straps.

In yet another example, a combination of different color coding and different configurations may be had for each security strap. For instance, the shape of each of the five differently colored security straps, including the pair of each male/female fastening parts, is shaped into five different configurations. This is particularly helpful in instances of color blindness where incorrect matching of male/female fastening parts prevents inaccurate security strap connections.

The therapeutic assistive device of the present invention also includes a wheel assembly, which is preferably attached at a base end of each anchor column, and configured with a substantially L-shaped arm. The length of a top surface of each arm, from the leg to an edge of the L-shaped arm, ranges between approximately two to four inches, such as three inches.

Preferably, only the arms of wheel assemblies attached to the bases of the two side anchor columns are swivable into one of three locked positions. Preferably, in a standard or default position, the wheel assembly's arm is lockable in a position that is generally perpendicular to the circumference of the support ring(s), such as the support ring nearest to ground level. This configuration ensures stability of the invention in closed as well as open (first and second) positions. Alternatively, the arms of these wheel assemblies may pivot into a lockable position that is approximately 90 degrees in either direction to the right or the left of the standard position such that the arm becomes substantially positioned in parallel with the circumference of a support ring.

In other words, each L-shaped arm of each wheel assembly is preferably fixed in a position that is substantially perpendicular to the largest support ring. Such positioning provides additional support to prevent user/device instability and prevent the device from toppling over. In addition, by moving or pivoting the L-shaped arms of the wheel assemblies on the side anchor columns approximately 90 degrees in either direction, each arm is lockable in a position substantially in parallel with the support rings, thereby reducing a width of the device by a total of approximately six inches—approximately three inches on either side of the device.

So, in instances when the arm is lockably positioned in line or in parallel with a support ring, dimensional clearance(s) of the device is reduced by the length of each wheel assembly arm. A user's desire to traverse a passageway of fixed dimensions, such as a narrower door opening in an older home, for example, may be achieved temporarily by pivoting one or more arms of the wheel assembly, to achieve desired clearances of the device without compromising stability.

In a preferred embodiment, adjustable height wheel assemblies are attached to a base end of each of the five anchor columns, to allow vertical adjustment of the device as desired. Preferably, the legs in each wheel assembly are vertically adjustable up to approximately six inches, which allows for user gait adjustments as well as adjustments to improve the center of gravity of the device.

Above has been outlined, rather broadly, a summary of the invention in order that a detailed description thereof that follows may be better understood, and in order that the present contribution may be better appreciated. As those skilled in the art will appreciate, there are, of course, additional aspects of the invention that will be described hereinafter and which will perform the subject matter of the claims appended thereto.

As such, before explaining the preferred embodiments of the present invention in detail, it is to be understood that the following description and depictions of the present invention are illustrative of preferred embodiment(s) of the invention for easy explanation and understanding thereof, and does not limit the invention in its application to the details of construction and to the arrangements of the elements set forth in the following description or illustrated in the drawings.

In addition, the conception and components of the present invention, which are derived through inventor experience and diligence and upon which this disclosure is based, may be readily used as a basis for the designing of other structures, methods and systems for carrying out the several aims of the present invention. Therefore, it is important that the claims be regarded as including such equivalent constructions insofar as they do not depart from the spirit and scope of the present invention.

Also, it is to be understood that the terminology and phraseology employed herein are for the purposes of description and should not be regarded as limiting. For example, any reference herein to terms such as "upper", "lower", "left", "right", "side", "front", "rear", "top", "bottom", "upper", "lower", "width", "length", "horizontal", "vertical", "beginning", "end", and the like, are used to merely describe one or more points of reference, and do not necessarily limit the present invention to a specific orientation. Likewise, reference to singular forms such as "a", "the", "an", and the like, for example, does not necessarily denote a limitation of quantity as used in the specification and claims, but rather denotes the existence of at least one of the referenced items, elements or components unless specified otherwise clearly.

BRIEF DESCRIPTION OF PREFERRED EMBODIMENTS

DETAILED DESCRIPTION OF PREFERRED EMBODIMENTS

Figure 1:
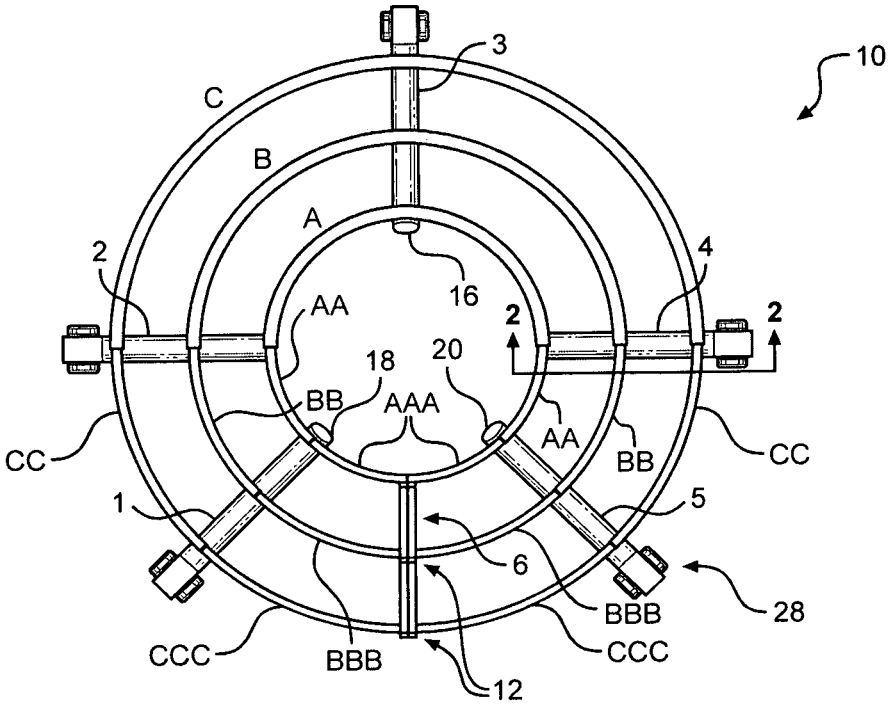
FIG. 1 is a top view of the present invention, in a closed position, in accordance with a preferred embodiment.

Referring to the figure drawings wherein like reference numerals indicate like elements, there is shown in FIG. 1 a top view of a preferred embodiment of the present invention 10 in closed position.

The therapeutic mobility assistive device 10 is accessed by opening each locking mechanism 12 on column portion 6 at the front of telescoping portions AAA, BBB, CCC of support rings A, B, C. As depicted, each support ring A, B, C, including each telescoping portion AA, BB, CC, AAA, BBB, CCC, is preferably configured in a stacking arrangement from top to bottom, respectively. On either side of fastening mechanism 12, telescoping portions AAA, BBB, CCC telescope rearwardly into telescoping portions AA, BB, CC, respectively, which in turn telescopes rearwardly into support rings A, B, C, respectively. Telescoping portions AA, BB, CC preferably telescopes rearwardly as far back as stationary anchor column 4 (on the left) and stationary anchor column 2 (on the right).

The diameter or circumference of each support ring A, B, C including each telescoping portion AA, BB, CC, AAA, BBB, CCC, as well as the distance between each support ring A, B, C with respect to each other, varies depending on the dimension or size of the user. For example, the diameter of each support ring A, B, C, which preferably ranges between one and three inches, such as two inches, is adequately sized to accommodate the diameters of corresponding telescoping portions AA, BB, CC, AAA, BBB, CCC. Alternatively, construction of support ring A, B, C, including telescoping portions AA, BB, CC, AAA, BBB, CCC, may take an oval or rectangular form of shape rather than a circular one, where the dimensions of support rings A, B, C preferably ranges between approximately one inch and three inches high, such as two inches high, and between one-quarter and one inch thick, such as one-half inch in thickness. Telescoping portions AA, BB, CC, AAA, BBB, CCC are consequently adequately sized to telescope within support rings A, B, C.

In addition, the horizontal distance between support rings A and B, and between support rings B and C, (see FIG. 2), preferably ranges between approximately four and eight inches, such as six inches, and the horizontal distance between support rings A and C preferably ranges between approximately eight inches and fourteen inches, to accommodate the size of each user.

In this regard, the therapeutic mobility assistive device 10 is customizable for each user based on their measurements such as, for example, in sizes of small, medium, large, extra large, and the like. In addition, the configuration of the stacking arrangement of each support ring A, B, C (including each telescoping portion), preferably ranges height-wise from approximately a user's elbow to approximately ten inches above a walking surface, in order to capture the user's center of gravity as well as allowing the necessary flexibility to accommodate a user's normal gait cycle when the user's foot elevates during a gait cycle inside the device, thereby preventing undesired or unwanted instability.

Preferably, support ring A (including telescoping portions AA, AAA) which is at the top of the stacking arrangement, forms the smallest circumference around a user's body, which circumference is approximately two feet in diameter (depending on the size of the user) or allows a clearance ranging from approximately three to six inches on either side of the user's waist; support ring B (including telescoping portions BB, BBB) is between support rings A and B in the middle of the stacking arrangement and is approximately six inches larger in circumference or clearance range than support ring A; and support ring C (including telescoping portions CC, CCC), which is located at the bottom of the stacking arrangement, forms the largest circumference around a user's body and is approximately six inches larger in circumference or clearance range than support ring B. Support ring C preferably ranges between approximately eight to twelve inches, such as ten inches, above a walking surface.

In addition, to ensure stability of the present invention, each of the three support rings A, B, C and corresponding telescoping portion AA, BB, CC, AAA, BBB, CCC is stabilized vertically by five anchor columns 1, 2, 3, 4, 5, which are angularly positioned therearound in connection across each support ring A, B, C for proper load distribution.

As illustrated in the preferred embodiment of FIG. 1, each support ring A, B, C has a rear or back, which is supported by anchor column 3. Preferably, anchor columns 2 and 4 are substantially stationary and fixed at an end area of support rings A, B, C that is approximately 90 degrees on either side from rear anchor column 3. In addition, anchor columns 1 and 5 are each substantially positioned and fixed at an end area of telescoping portion AA, BB, CC approximately 150 degrees on either side from rear anchor column 3, or approximately 60 degrees forwardly from columns 2 and 4, respectively. Anchor columns 1, 2, 3, 4, 5 stabilize support rings A, B, C and telescoping portions AA, BB, CC, AAA, BBB, CCC in angularly positioned therearound or vertical connections across support rings A, B, C and portions AA, BB, CC.

The therapeutic device 10 is preferably of a unibody and/or monocoque construction that adequately absorbs support loads and stresses. In an exemplary construction, for example, support rings A, B, C and anchor columns 2, 3, 4, which support the rear and sides of the device, may be of a single unitary construction without screws or bolts, with anchor columns 1, 5, telescoping portions AA, BB, CC, AAA, BBB, CCC and column portion 6 preferably being integrally incorporated with support rings A, B, C without screws or bolts. Alternatively, the desired support loads and stresses may be supported by another construction of the complementary elements of the therapeutic device 10 that may not be unibody or monocoque in design. The therapeutic device 10 is preferably made of a high-strength, lightweight, corrosion-resistant material including, for example, aluminum, poly-ethylene, etc.

Figure 2:
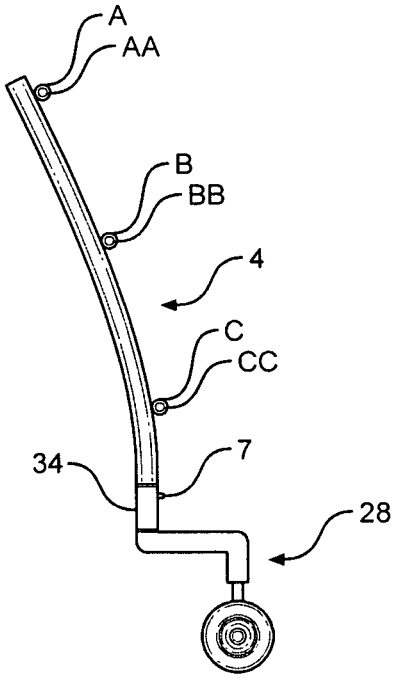
FIG. 2 is an exemplary side view of column 4 along line 2-2 in accordance with the preferred embodiment depicted in FIG. 1.

Referring now to FIG. 2, there is shown an exemplary side view of anchor column 4 along line 2-2 in accordance with the preferred embodiment depicted in FIG. 1. In addition to a wheel assembly 28, which will be later described with reference to FIGS. 6 and 7, each anchor column 1, 2, 3, 5, like anchor column 4, is preferably bowed in a substantially concavely shape from support ring A downwardly to leg 34 of the wheel assembly 28, a configuration that not only facilitates equal distributive loading throughout the anchor columns 1, 2, 3, 4, 5, and hence throughout the device 10, but also accommodates a normal gait cycle of the user.

In this configuration the horizontal distance between the vertical line passing through the point depicted by support ring A and the point depicted by support ring B, preferably ranges between approximately four to eight inches, such as six inches. Similarly, the horizontal distance between the vertical lines passing through the point depicted by support ring B and the point depicted by support ring C, preferably ranges between approximately four to eight inches, such as six inches.

In addition, the horizontal distance between the vertical lines passing through the point depicted by support ring A and the point depicted by support ring C, preferably ranges between approximately eight to fourteen inches. The above dimensions and configuration of the present invention offer flexibility, which accommodates the size and normal gait cycle of each user in a way that facilitates appropriate distributive loading and stresses throughout the device 10.

Figure 3:
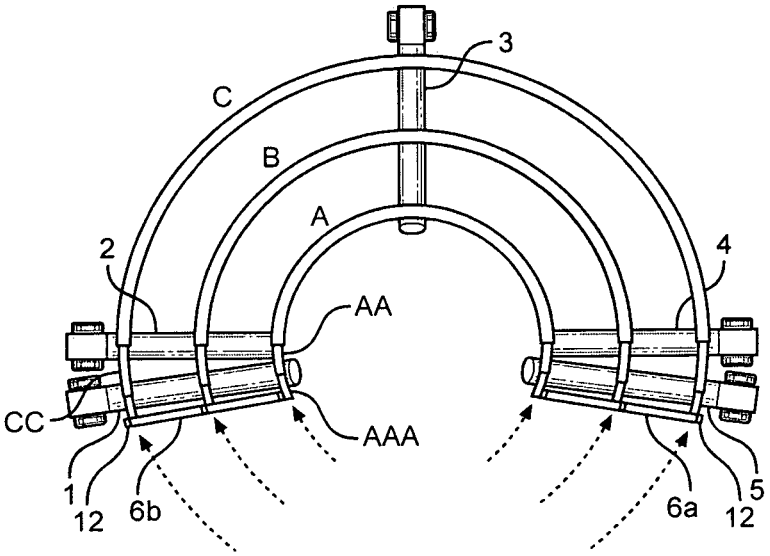
FIG. 3 is an exemplary top view of the present invention, in a second open position, in accordance with the preferred embodiment depicted in FIG. 1.

Referring now to FIG. 3, there is shown an open position of the device 10 in its widest condition, referred to as a second open position. The second open position is created when the fastening mechanism 12, which is located at the front of each telescoping portion AAA, BBB, CCC and located approximately 90 degrees forwardly from anchor columns 2, 4, is unlocked and pushed to a maximum in a generally rearwardly direction, allowing each telescoping portion AA, BB, CC, AAA, BBB, CCC to slide telescopingly towards the rear of the device in the direction of anchor columns 2, 4, as depicted by the dashed arrows.

Figure 4:
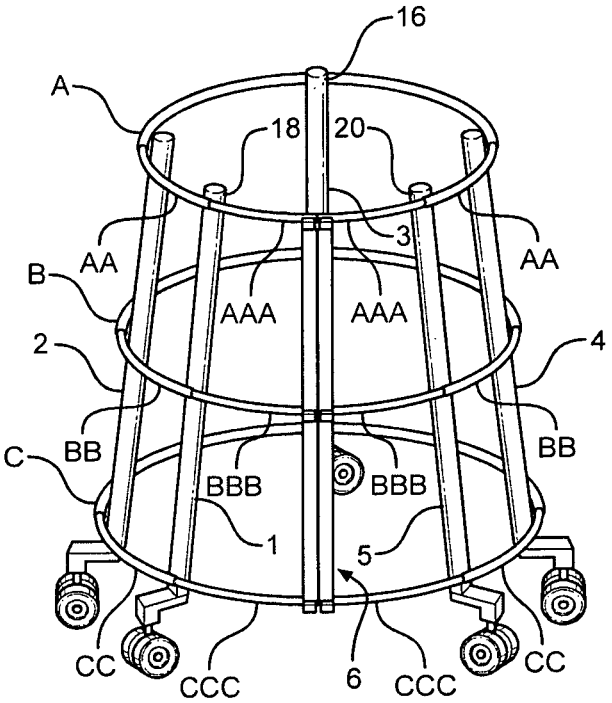
FIG. 4 is a perspective view of the present invention in accordance with the preferred embodiment depicted in FIG. 1.

To be more specific, for example, with reference to the preferred embodiment illustrated in FIGS. 3 and 4, when telescoping portions AAA, BBB, CCC are unlocked via and at fastening mechanism 12, column portion 6*a* (FIG. 3) is pushed in a general direction towards anchor column 5 (FIG. 4). Similarly, column portion 6*b* (FIG. 3) is pushed in a generally rearwardly direction towards anchor column 1 (FIG. 4).

Figure 8:
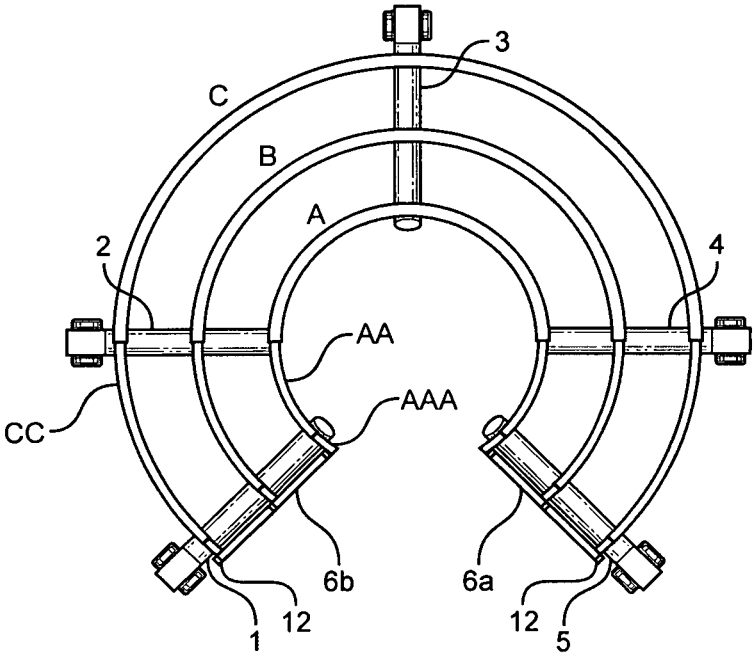
FIG. 8 is an exemplary top view of the present invention, in a first open position, in accordance with the preferred embodiment depicted in FIG. 1.

Owing to the length of each telescoping portion AAA, BBB, CCC preferably being of a fixed appropriate length, when column portion 6*a* (FIG. 3) is pushed in the general direction towards anchor column 5 (FIG. 4), telescoping portions AAA, BBB, CCC slides telescopingly into telescoping portions AA, BB, CC until telescoping portions AAA, BBB, CCC reaches an end of its fixed length and stops substantially when column portion 6*a* is adjacent and substantially juxtaposed to anchor column 5, which is approximately 150 degrees from rear anchor column 3. This process is repeated for column portion 6*b* (FIG. 3) with respect to anchor column 1, thereby creating a first open position of the device 10 as preferably depicted in FIG. 8.

Preferably in the first open position of the device 10, column portion 6*a* is substantially juxtaposed between approximately one to five degrees from anchor column 5, which is approximately 150 degrees from anchor column 3, and column portion 6*b* is substantially juxtaposed between approximately one to five degrees from anchor column 1, which is also approximately 150 degrees from anchor column 3, thereby creating an opening for user entry/exit into/from the device 10.

To achieve a wider opening if necessary, column portion 6*a* (FIG. 3) is pushed further in the direction of the dashed arrows causing telescoping portions AA, BB, CC to slide telescopingly into support rings A, B, C until telescoping portions AA, BB, CC reaches an end of its preferably fixed length and stops substantially when anchor column 5 is adjacent and substantially juxtaposed to anchor column 4, which is approximately 90 degrees from rear anchor column 3. This process is repeated for column portion 6*b* (FIG. 3) with respect to anchor column 1, which stops substantially when anchor column 1 is adjacent and substantially juxtaposed to anchor column 2, which is also approximately 90 degrees from rear anchor column 3, thereby creating a second open position of the device 10.

Preferably, in the second open position of the device 10, column portion 6*a* and anchor column 5 are adjacent or substantially juxtaposed between approximately one to five degrees from anchor column 4, which is approximately 90 degrees from rear anchor column 3; and column portion 6*b* and anchor column 1 are adjacent or substantially juxtaposed between approximately one to five degrees from anchor column 2, which is also approximately 90 degrees from rear anchor column 3, thereby creating the widest opening for user entry/exit into/from the device 10 as depicted in FIG. 3.

The above described configurations and arrangement of the therapeutic assistive device 10 of the present invention maintains stability of the device 10 in any of the first and second open positions, which allows adequate ingress or egress, as well as in the closed position for safe use or user rest periods. Additionally, through these same configuration and arrangement, each fixed connection in the therapeutic assistive device 10 withstands appropriate yield and tensile loads and stresses.

To achieve the closed position depicted in FIGS. 1 and 4 from the second open position depicted in FIG. 3, the process described above is reversed. For example, anchor column 5 is pulled in a direction opposite the dashed arrows shown in FIG. 3, towards the front of the therapeutic assistive device 10. By so doing, telescoping portions AA, BB, CC slides to its original fully extended length, positioning anchor column 5 at approximately 150 degrees from rear anchor column 3. Then column portion 6*a* is further pulled forwardly, in a direction that is opposite to the dashed arrows depicted in FIG. 3, such that telescoping portions AAA, BBB, CCC slides to its original fully extended length, positioning column portion 6*a* at approximately 180 degrees from anchor column 3.

This process is repeated with respect to anchor column 1, which becomes re-positioned at approximately 150 degrees from rear anchor column 3, and with respect to column portion 6*b*, which becomes re-positioned at approximately 180 degrees from rear anchor column 3, such that fastening mechanism 12 on telescoping portions AAA, BBB, CCC reach a locking position thus creating the closed position depicted in FIGS. 1 and 4.

Alternatively, the therapeutic assistive device 10 may also be closed by pulling on column portion 6*b* with the understanding that doing so causes telescoping portions AAA, BBB, CCC to slide to its original fully extended length in turn causing telescoping portions AA, BB, CC to slide to its original fully extended length, for the right side of the device 10. This process may be repeated for the left side of the device 10 by pulling forwardly on column portion 6*a*, until fastening mechanism 12 on column portion 6 reaches an original locking position, thus creating the closed position depicted in FIGS. 1 and 4.

Figure 5:
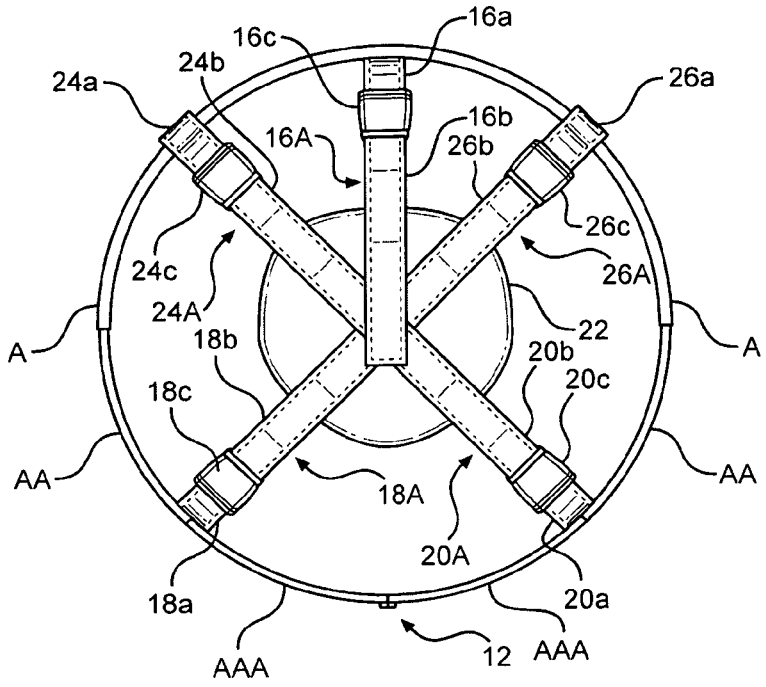
FIG. 5 is a top view of an exemplary harness and security straps of the present invention in accordance with a preferred embodiment.

Referring now to FIGS. 5 and 4, in a preferred embodiment, extending inwardly into a circumference of support ring A from ends 16, 18, 20 of anchor columns 3, 1, 5, respectively, in FIG. 4, are a first part 16*a*, 18*a*, 20*a* (FIG. 5) of security straps 16A, 18A, 20A, which are attached to a seat or harness 22 (FIG. 5) useful in securing a user for safe operation of therapeutic assistive device 10.

As illustrated in FIG. 4, ends 16, 18, 20 preferably extend beyond a top surface of support ring A to provide additional stability of the device 10 and support of the user. The first parts 16*a*, 18*a*, 20*a* (FIG. 5) of security straps 16A, 18A, 20A are fixedly attached to ends 16, 18, 20 (FIG. 4), respectively, which are preferably substantially the same width of each security strap 16A, 18A, 20A.

As with anchor columns 2, 4, the dimensions of anchor columns 3, 1, 5 including ends 16, 18, 20, onto which security straps 16A, 18A, 20A are fixedly attached, ranges preferably between approximately two to four inches wide, such as three inches, and approximately one-half to one-and-a-half inches in thickness, such as one inch. Also, as with support rings B, C, the dimension of support ring A (FIG. 5), through which telescoping portions AA, AAA slide therein, preferably ranges between approximately one to three inches in height, such as two inches, and approximately one-quarter to three-quarter inches in thickness, such as one-half inch. As earlier stated, the shape of support rings A, B, C is not limited to a circular one.

Referring now to FIG. 5, there is shown a top view of an exemplary seat or harness with security straps, useful for securing a user in the present invention. For example and preferably, all five security straps 16A, 18A, 20A, 24A, 26A comprises two parts: a first part 16*a*, 18*a*, 20*a*, 24*a*, 26*a*, and a second part 16*b*, 18*b*, 20*b*, 24*b*, 26*b*. Each fastening connector 16*c*, 18*c*, 20*c*, 24*c*, 26*c* for security straps 16A, 18A, 20A, 24A, 26A is preferably in the form of a two-part mating fastening connector, similar to a seat belt. Preferably, each fastening connector, as at 16*c*, 18*c*, 20*c*, 24*c*, 26*c*, is color coded with a different color.

In an exemplary embodiment, with reference to security strap 16A for instance, the two-part mating fastening connector comprises a male part (not shown) and a female part 16*c*. Preferably, the distal end of the first part 16*a* of security strap 16A is the male part, which is inserted into the first female part 16*c*. The female part 16*c*, which is attached to the distal end of the second part 16*b* of security strap 16A, receives the male part and thereby facilitates a proper mating connection of strap parts 16*a* and 16*b* as at 16*c*.

Similarly, with reference to security strap 26A, for instance, preferably the distal end of the first part 26*a* of security strap 26A is the male part (not shown). The female part 26*c*, which is attached to the distal end of the second part 26*b* of security strap 26A, receives the male part and thereby facilitates a proper mating connection of first strap part 26*a* and second strap part 26*b* as at 26*c*. The same two-part (male and female) mating fastening connector applies to security straps 18A, 20A, 24A as described above.

The first part 24*a*, 26*a* of security strap 24A, 26A, respectively, are preferably angularly fixedly attached or supported on support ring A whereas the first parts 16*a*, 18*a*, 20*a* of security straps 16A, 18A, 20A are supported from the ends 16, 18, 20 of anchor columns 3, 1, 5, respectively. In other words, while a proper mating connection of first strap part 16*a*, 18*a*, 20*a*, 24*a*, 26*a* and second strap part 16*b*, 18*b*, 20*b*, 24*b*, 26*b* occurs at 16*c*, 18*c*, 20*c*, 24*c*, 26*c* for each security strap 16A, 18A, 20A, 24A, 26A, the first part 16*a* of security strap 16A extends from a top end of rear anchor column 3 towards seat 22 for fastening arrangement with second security strap part 16*b*. Similarly, the first part 18*a*, 20*a* of security strap 18A, 20A extends from a top end of anchor column 1, 5, respectively, in substantially the same way towards seat 22 for fastening arrangement with second security strap part 18*b*, 20*b*, respectively.

Since the first part 16*a*, 18*a*, 20*a* of security strap 16A, 18A, 20A preferably extends from anchor column ends 16, 18, 20, respectively, for fastening connection as at 16*c*, 18*c*, 20*c*, the first part 16*a*, 18*a*, 20*a* of security strap 16A, 18A, 20A extends from an area inside or within the circumference of support ring A at the location of anchor columns 3, 1, 5, respectively. Accordingly, security strap 18A, 20A is approximately 150 degrees on either side of security strap 16A, or approximately 150 degrees on either side of rear anchor column 3. In addition, the first part 24*a*, 26*a* of security strap 24A, 26A is fixedly attached onto support ring A at a location that is approximately 45 degrees on either side of security strap 16A, or approximately 45 degrees on either side of rear anchor column 3.

Preferably, security straps 16A, 18A, 20A, 24A, 26A, including each male part (not shown) and female part 16*c*, 18*c*, 20*c*, 24*c*, 26*c*, are preferably color coded differently with respect to each other such as yellow for strap 26A, red for strap 24A and the like. For example, security strap 16A, including the female and male parts of the fastening connector, may be coded a different color (i.e. sky blue) than security strap 18A (i.e. black), and in turn a different color from security strap 20A (i.e. red), to eliminate the possibility of incorrectly connecting, for example, the second part 16*b* (sky blue) of security strap 16A with the first part 18*a* (black) of security strap 18A. Alternatively, the mating female and male parts only of each fastening connector as at 16*c*, 18*c*, 20*c*, 24*c*, 26*c* may be color coded.

In the event of color blindness, for instance, each male part of first strap part 16*a*, 18*a*, 20*a*, 24*a*, 26*a* may also be configured in a different shape so that, for example, the shape of the male part of first strap part 24*a* would not mate with any other second strap part 16*b*, 18*b*, 20*b*, 26*b* except the shape of the female second strap part 24*b*, and the like.

Like the security straps 16A, 18A, 20A, 24A, 26A, seat portion or harness 22 is preferably constructed of a durable, high-strength, light-weight material that accommodates appropriate strength loads and stresses. Seat 22 is also preferably flexible and of a general circular shape to facilitate a user's posterior as well as a user's leg between straps 18A and 24A, and between straps 20A and 26A.

The length of each security strap 16A, 18A, 20A, 24A, 26A is also adjustable via second strap parts 16*b*, 18*b*, 20*b*, 24*b*, 26*b* in order to accommodate varying user sizes, such as small, medium, large, extra large, and the like, as well as to ensure proper fit and comfort, and to provide adequate support. Adjustability is achieved by lengthening second strap parts 16*b*, 18*b*, 20*b*, 24*b*, 26*b* as desired conventionally.

Preferably operationally, the first parts 16*a*, 18*a*, 20*a* of security strap 16A, 18A, 20A are hanging from the ends 16, 18, 20 of anchor column 3, 1, 5, respectively, towards the middle of support ring A and telescoping portion AA, as is first strap part 24*a*, 26*a* of security strap 24A, 26A similarly hanging from support ring A towards the middle of support ring A. Once fastening mechanism 12 is unlocked, therapeutic assistive device 10 is opened to a first or second open position, as earlier described.

Once device 10 is opened as desired, second strap part 24*b*, 16*b*, 26*b* are matingly connected to first strap part 24*a*, 16*a*, 26*a*, respectively, as at 24*c*, 16*c*, 26*c*, respectively, thereby fastening security strap 24A, 16A, 26A, respectively, and thus the rear portion of seat 22 to the device 10.

Once these connections are made, the rear portion of seat 22 and fastened security strap 16A, 24A, 26A are ready to receive the posterior of the user, with the user's knees preferably facing the opening or front of the device 10. The device 10 is returned to the closed position as earlier described, and second strap part 18*b*, 20*b* is lifted forwardly between the user's legs for connection to first strap part 18*a*, 20*a*, respectively, as at 18*c*, 20*c*, respectively. In other words, the harness 22 is positioned as a seat where the right leg is positioned between straps 18A and 24A, and the left leg is positioned between straps 20A and 26A. Security strap 16A, 18A, 20A, 24A, 26A are adjusted via second strap part 16*b*, 18*b*, 20*b*, 24*b*, 26*b*, if necessary, to raise or lower seat 22 as desired for appropriate fit, stability and user comfort. At this juncture, the therapeutic assistive device 10 is ready for safe, balanced mobility activity.

Figure 6:
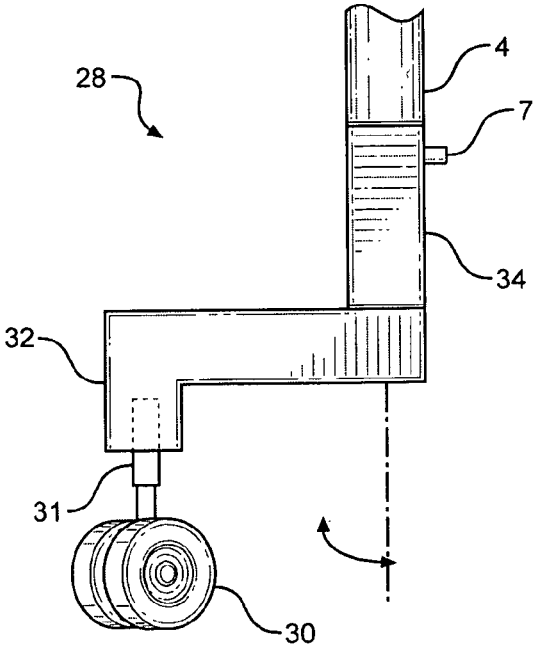
FIG. 6 is a more detailed front view of an exemplary wheel assembly on anchor column 4 in accordance with the preferred embodiment depicted in FIG. 2.
Figure 7:
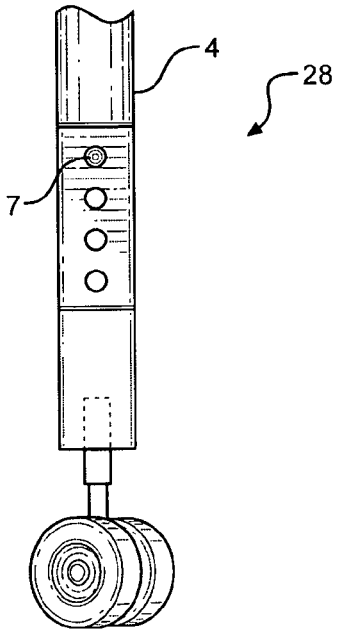
FIG. 7 is a side view of the exemplary wheel assembly in accordance with the preferred embodiment depicted in FIG. 6.

Referring now to FIGS. 6 and 7, there is shown more detailed front and side views of an exemplary wheel assembly 28 of the device 10. Each wheel assembly 28 is attached at a base of each anchor column 1, 2, 3, 4, 5, which is adjustable vertically by approximately six inches. As depicted in FIGS. 6 and 7, wheel assembly 28 is attached at the base of column 4, which is adjusted to a maximum height adjustment, as pin 7 is in the top hole. Adjustability is achieved by moving pin 7 up or down into any one of the circular holes (not numbered) shown in leg 34 in FIG. 7.

Since the vertical distance of support ring C preferably ranges between approximately six to ten inches above the floor, such as eight inches, the adjustability of anchor column 4 (as well as anchor columns 1, 2, 3, 5) to a maximum height adjustment translates into an additional height of approximately six to ten inches. This adjustment may be necessary for taller users in order, for example, to support a higher center of gravity and allow, during the user's gait cycle, the foot to elevate during the swing phase of the user's gait.

Each wheel assembly preferably 28 comprises lockable (not shown) double-wheel swivel casters 30 that are attached to an L-shaped arm 32 via pin 31. Pin 31 may be equipped with a hydraulic shock absorber for a less bumpy walking experience. Double wheels 30 may range between approximately two to four inches, such as three inches, and swivel in any direction.

While leg 34 facilitates vertical adjustment of the device 10 between approximately zero and six inches to improve center-of-gravity and gait adjustments depending on the user, arm 32 facilitates in-line, lockable rotational adjustment of each wheel 30 to support the device 10. A top surface of each arm 32 from leg 34 to the edge (FIG. 6) ranges between approximately two and four inches, such as three inches, and is in a standard position generally perpendicular to support ring C as well as support ring A, B. Preferably, the default arrangement of these L-shaped arms 32 in the standard position provides added support to users especially in loss-of-balance situations, and prevents the device 10 from toppling over or the like. This configuration ensures stability of the invention in closed as well as open (first and second) positions.

Preferably, only arm 32 of each wheel assembly 28 for anchor columns 2 and 4, which is approximately three inches in length, is swivable into one of any three locked positions via ball bearings—in a position generally perpendicular to support ring A, B, C (standard position), or in a position approximately 90 degrees in either direction from the standard position; namely, in parallel with support ring C to the left, or in parallel with support ring C to the right.

This flexibility allows arm 32, for example, to rotate approximately 90 degrees from the position depicted in FIG. 6 to the in-line position depicted in FIG. 7, which is in parallel with support ring A, B, C (not shown), thereby reducing the side clearances of the wheel assemblies 28 at anchor columns 2 and 4 only (FIG. 4) by approximately six inches—three inches on each side when arm 32 is rotated in line with support ring C (FIG. 4). This may be helpful for users who need to navigate narrower doorways and passageways in the device 10. Alternatively and optionally, anchor column 1, 3, 5 may be equipped with wheel assembly 28 having lockable arm 32, which is preferably locked in the standard position.

Although the present invention has been described with reference to preferred embodiments, these embodiments are intended to illustrate the principles of the invention and not to limit the scope of the invention. It will be apparent to those skilled in the art that various modifications and variations can be had to the disclosed apparatus and method. Other embodiments in addition to the preferred embodiments disclosed herein may be made from consideration of the specification and practice of the disclosed apparatus and method, without departing from the scope of the following claims and equivalents. In addition, various modes of carrying out the invention are contemplated as being within the scope of the following claims particularly pointing out and distinctly claiming the subject matter regarded as the invention. All such suitable modes, modifications and equivalents of the present invention are contemplated as being within the spirit and scope of the present invention, as it is intended that the specification and examples be considered as exemplary only, with a true scope being indicated by the following claims and their equivalents.

What is claimed is:

1. A therapeutic mobility assistive device comprising:

(a) at least two support rings each having varying circumferences and each having vertical distances therebetween in a stacking arrangement;

(b) at least three anchor columns angularly positioned in connection across said support rings, said anchor columns stabilizing said device;

(c) a fastening mechanism supporting each support ring, said fastening mechanism creating a closed position, a first open position and a second open position of said device, said second open position comprising a rear anchor column, an anchor column approximating 90 degrees from either side of the rear anchor column, an anchor column on either side of the rear anchor column positioned juxtaposed to the anchor column approximating degrees from either side of the rear anchor column, and a column portion on either side of the rear anchor column positioned juxtaposed to the anchor column approximating 90 degrees from either side of the rear anchor column;

(d) a harness comprising a seat connected to an anchor column; and (e) a wheel assembly attached at a base end of each anchor column.

2. The therapeutic mobility assistive device according to claim 1, wherein said angularly positioned anchor columns comprising a rear anchor column, an anchor column approximating 90 degrees from either side of the rear anchor column, and an anchor column approximating 150 degrees from either side of the rear anchor column.

3. The therapeutic mobility assistive device according to claim 1, wherein said first open position comprising a rear anchor column, an anchor column approximating 90 degrees from either side of the rear anchor column, an anchor column approximating 150 degrees from either side of the rear anchor column, and a column portion on either side of the rear anchor column positioned juxtaposed to the anchor column approximating 150 degrees from either side of the rear anchor column.

4. The therapeutic mobility assistive device according to claim 1, wherein said support rings comprising telescoping portions movement of which creates a closed position, a first open position and a second open position of said device.

5. The therapeutic mobility assistive device according to claim 1, wherein said stacking arrangement comprising a support ring at a top position having a smaller circumference than a support ring at a bottom position.

6. The therapeutic mobility assistive device according to claim 1, wherein a security strap is angularly positioned about the circumference of a support ring.

7. The therapeutic mobility assistive device according to claim 1, wherein a security strap is angularly positioned in tandem with a rear anchor column and an anchor column approximating 150 degrees from either side of the rear anchor column.

8. The therapeutic mobility assistive device according to claim 1, wherein a security straps is angularly positioned in tandem with a rear anchor column and a position approximating 45 degrees on either side from the rear anchor column.

9. The therapeutic mobility assistive device according to claim 1, wherein said anchor columns and support rings formed of integral construction.

10. The therapeutic mobility assistive device according to claim 1, wherein a column portion supports each support ring at a front of said device.

11. The therapeutic mobility assistive device according to claim 1, wherein each anchor column is substantially concave in shape.

12. The therapeutic mobility assistive device according to claim 1, wherein said harness further comprising a security strap having a first part connected to a support ring and a second part connected to said seat portion.

13. The therapeutic mobility assistive device according to claim 1, wherein said wheel assembly comprising an arm lockable in a position perpendicular to the circumference of said support rings.

14. The therapeutic mobility assistive device according to claim 1, wherein said wheel assembly comprising an arm equipped on the base end of an anchor column approximating 90 degrees on either side only from the rear column.

15. The therapeutic mobility assistive device according to claim 1, wherein said wheel assembly comprising an arm that is L-shaped and, when locked in a position perpendicular to said support rings, stabilizes said device in a closed position, a first open position and a second open position.

16. The therapeutic mobility assistive device according to claim 1, wherein said wheel assembly comprising an arm lockable in a position parallel with said support rings, reducing at least one side clearance of said device.

17. A method of using a therapeutic mobility assistive device, comprising the method steps of:

(a) opening support rings of the device to at least one of a first open position and a second open position, which comprises a rear anchor column, an anchor column approximating 90 degrees from either side of the rear anchor column, an anchor column on either side of the rear anchor column positioned juxtaposed to the anchor column approximating 90 degrees from either side of the rear anchor column, and a column portion on either side of the rear anchor column positioned juxtaposed to the anchor column approximating 90 degrees from either side of the rear anchor column;

(b) installing a harness; and (c) closing said support rings of the device.

18. The method of claim 17, wherein the step of installing a harness comprises a step of attaching a first part and second part of a security strap forming a rear portion of a seat.

19. The method of claim 17, wherein the step of installing a harness comprises a step of lifting a second part of a security strap into connection with a first part of a security strap, said harness positioned as a seat.

* * * * *